US006106638A

United States Patent [19]

Paradis et al.

[11] Patent Number: 6,106,638

[45] Date of Patent: Aug. 22, 2000

[54] PROCESS FOR MANUFACTURING THIN STRIP OF FERRITIC STAINLESS STEEL, AND THIN STRIP THUS OBTAINED

[75] Inventors: Philippe Paradis, Isbergues; Philippe Martin, Aire sur la Lys, both of France

[73] Assignee: Usinor, Puteaux, France

[21] Appl. No.: 09/075,533

[22] Filed: May 11, 1998

[30] Foreign Application Priority Data

May 29, 1997 [FR] France ..... 97 06576

[51] Int. Cl.[7] ..... C22C 38/18; C21D 9/52

[52] U.S. Cl. ..... 148/325; 148/601; 148/602; 148/605; 148/542; 148/607; 148/608

[58] Field of Search ..... 148/325, 601, 148/602, 605, 607, 608, 542, 654, 661

[56] References Cited

FOREIGN PATENT DOCUMENTS

| | | | |
|---|---|---|---|
| 471608 | 2/1992 | European Pat. Off. . | |
| 638653 | 8/1994 | European Pat. Off. . | |
| 691412 | 1/1996 | European Pat. Off. . | |
| 4017989 | 9/1991 | Germany . | |
| 57-155326 | 9/1982 | Japan | 148/602 |
| 5-293595 | 9/1993 | Japan . | |
| 8-295943 | 11/1996 | Japan . | |

OTHER PUBLICATIONS

International Search Report.

*Primary Examiner*—Deborah Yee

*Attorney, Agent, or Firm*—Nixon Peabody LLP; Thomas W. Cole

[57] ABSTRACT

The subject of the invention is a process for manufacturing ferritic stainless steel strip, in which a strip of a ferritic stainless steel, of the type containing at most 0.12% of carbon, at most 1% of manganese, at most 1% of silicon, at most 0.040% of phosphorus, at most 0.030% of sulfur and between 16 and 18% of chromium, is solidified, directly from liquid metal, between two close-together, internally-cooled, counterrotating rolls with horizontal axes, wherein said strip is then cooled or left to cool so as to avoid making it remain within the austenite to ferrite and carbides transformation range, wherein said strip is coiled at a temperature of between 600° C. and the martensitic transformation temperature Ms, wherein the coiled strip is left to cool at a maximum rate of 300° C./h down to a temperature of between 200° C. and ambient temperature and wherein said strip then undergoes box annealing. The subject of the invention is also a ferritic stainless steel strip of the type containing at most 0.12% of carbon, at most 1% of manganese, at most 1% of silicon, at most 0.040% of phosphorus, at most 0.030% of sulfur and between 16 and 18% of chromium, wherein it is capable of being obtained by the above process.

7 Claims, 3 Drawing Sheets

PROCESS FOR MANUFACTURING THIN STRIP OF FERRITIC STAINLESS STEEL, AND THIN STRIP THUS OBTAINED

FIELD OF THE INVENTION

The invention relates to the metallurgy of stainless steels. More particularly, it relates to the casting of ferritic stainless steels in the form of strip a few mm in thickness, directly from liquid metal.

PRIOR ART

For several years, research has been conducted on the casting of steel strip a few mm in thickness (at most 10 mm), directly from liquid metal, on so-called "twin-roll continuous casting" plants. These plants principally comprise two rolls having horizontal axes, placed side by side, each having an external surface which is a good conductor of heat and vigorously cooled internally, and defining between them a casting space whose minimum width corresponds to the thickness of the strip which it is desired to cast. This casting space is closed off laterally by two refractory walls applied against the ends of the rolls. The rolls are driven in counterrotation and the casting space is fed with liquid steel. Steel "shells" solidify against the surfaces of the rolls and join in the "nip", i.e. at the point where the distance between the rolls is a minimum, in order to form a solidified strip which is continuously extracted from the plant. This strip is then cooled naturally or force-cooled, before being coiled. The objective of this research is to be able, using this process, to cast strip made of various grades of steel, especially stainless steels.

Under the most common casting conditions, in which the strip leaving the rolls cools naturally in the open air, the strip is usually coiled at a temperature of about 700 to 900° C., depending on its thickness and the rate of casting. The coiling temperature also depends, of course, on the distance between the rolls and th coiler. The coiled strip is then left to cool naturally, before it is subjected to metallurgical treatments comparable to those usually performed on hot-rolled strip produced from conventional continuous casting slab.

The application of this casting process to ferritic stainless steels of the AISI 430 standard type, which typically contain 17% of chromium, has shown that the strip thus obtained had poor ductility. Consequently, the thinnest strip (the thickness of which is about 2 to 3.5 mm) is excessively brittle and does not withstand the subsequent handling operations, carried out at ambient temperature, such as uncoiling and edge cropping: during these operations, cracks appear on the edges of the strip, or the strip may even break during uncoiling.

This poor ductility is usually explained by several factors:

- the as-cast strip essentially has a columnar structure consisting of coarse ferritic grains (the average grain size is greater than 300 μm in the thickness of the strip), which is a direct consequence of the succession of a rapid solidification on the rolls and of the strip remaining at a high temperature after it has left the rolls, when it does not undergo forced cooling;
- the ferritic grains have a high hardness due to their supersaturation in terms of interstitial elements (carbon and nitrogen);
- the presence of martensite arising from the hardening of the austenite present at high temperature.

In order to remedy this, it has been envisaged to subject the coils, after they have cooled, to box annealing at a temperature below the temperature (called Ac1) for transforming the ferrite into austenite during reheat. Conventionally, this annealing is carried out at approximately 800° C. for at least 4 hours. The aim is thus to precipitate carbides from the ferritic matrix, to transform the martensite into ferrite and carbides, and to coalesce the chromium carbides, so as to soften the metal. This treatment should improve the mechanical properties and the ductility, despite the retention of the columnar structure consisting of coarse ferritic grains. However, tests carried out on an industrial scale have shown that this method was insufficient for obtaining strip of suitable ductility.

This persistent brittleness of the strip after box annealing is explained by the fact that the as-cast strip, once coiled, only undergoes very slow cooling since its two faces are in contact with hot metal and only its edges are in contact with ambient air and free to radiate. This very slow cooling leads to abundant precipitation of carbides from the ferrite and to the transformation of part of the austenite into ferrite and carbides, while the rest of the austenite, on cooling, forms martensite. The box annealing makes it possible to complete the decomposition of martensite into ferrite and carbides, but, above all, it contributes to the coalescence of coarse carbides in the form of continuous films. The brittleness of the metal is specifically due to these coarse carbides, the size of which is about 1 to 5 μm. They constitute initiation sites for cracks, which propagate by cleavage in the surrounding ferritic matrix: their undesirable effect is added to that of the coarse-grained columnar structure.

Consequently, various attempts have been made to develop a twin-roll casting process for ferritic stainless steel strip having good ductility. The attempts are aimed at modifying the nature of the precipitates formed while the strip is cooling, or to "break" the as-cast structure consisting of coarse ferritic grains.

In this regard, mention may be made of document JP-A-62247029 which recommends in-line cooling at a rate greater than or equal to 300° C./s, between 1200 and 1000° C., followed by a coiling, which is carried out between 1000 and 700° C.

Document JP-A-5293595 recommends coiling at a temperature of 700 to 200° C., while giving the steel low carbon and nitrogen contents (0.030% or less) and a niobium content of 0.1 to 1%, the niobium acting as a stabilizer.

Other documents propose carrying out hot in-line rolling, which is added to the above carbon and nitrogen analytical constraints and can also be combined with niobium stabilization or nitrogen stabilization (see documents JP-A-2232317, JP-A-6220545, JP-A-8283845, JP-A-8295943).

Mention may also be made of document EP-A-0638653 which discloses, for a steel containing 13–25% of chromium, imposing a total of the niobium, titanium, aluminum and vanadium contents of 0.05 to 1.0%, a total of the carbon and nitrogen contents of 0.030% at most and a molybdenum content of 0.3 to 3%. The composition by weight of the steel must furthermore satisfy the condition "$\gamma p \leqq 0\%$". $\gamma p$ is a criterion representative of the amount of austenite formed on precipitation. It is calculated using the formula: $\gamma p = 420\times\%C + 470\times\%N + 23\times\%Ni + 9\times\%Cu + 7\times\%Mn - 11.5\times\%Si - 12\times\%Mo - 23\times\%V - 47\times\%Nb - 49\times\%Ti - 52\times\%Al + 189$.

In addition, the strip must be hot rolled within the 1150–900° C. temperature range with a reduction ratio of 5 to 50%, then be cooled at a rate of less than or equal to 20° C./s or be held within the 1150–950° C. temperature range for at least 5 s and, finally, be coiled at a temperature of less than or equal to 700° C.

In order to implement all these methods, it is therefore necessary to combine:

- expensive and difficult smelting of the liquid metal intended for casting the strip, if it is desired to obtain the low carbon and nitrogen contents necessary, or even, where appropriate, the desired contents of stabilizing elements;
- thermomechanical and heat treatments carried out on the casting line by means of expensive plants (in-line hot rolling mill); and
- carrying out complex thermal cycles also requiring plants which are specially adapted in order to obtain the high cooling rates or high-temperature hold times necessary.

SUMMARY OF THE INVENTION

The object of the invention is to provide an economic method of producing thin strip of ferritic stainless steel of AISI 430 and similar types by twin-roll casting, which gives said strip sufficient ductility to allow the uncoiling, edge-cropping and cold conversion (pickling, rolling, etc.) operations to be carried out without the occurrence of incidents such as strip breakage or the appearance of edge cracks. In order for the economic objective to be achieved, this process should not include steps requiring the addition of complex plant to a standard twin-roll caster. It should also not require carrying out liquid-metal smelting for the purpose of obtaining very low contents of elements such as carbon and nitrogen, and not require adding expensive alloying elements.

The subject of the invention is a process for manufacturing ferritic stainless steel strip, in which a strip of a ferritic stainless steel, of the type containing at most 0.12% of carbon, at most 1% of manganese, at most 1% of silicon, at most 0.040% of phosphorus, at most 0.030% of sulfur and between 16 and 18% of chromium, is solidified, directly from liquid metal, between two close-together, internally-cooled, counterrotating rolls with horizontal axes, wherein said strip is then cooled or left to cool so as to avoid making it remain within the austenite to ferrite and carbides transformation range, wherein said strip is coiled at a temperature of between 600° C. and the martensitic transformation temperature Ms, wherein the coiled strip is left to cool at a maximum rate of 300° C./h down to a temperature of between 200° C. and ambient temperature and wherein said strip then undergoes box annealing.

The subject of the invention is also a ferritic stainless steel strip of the type containing at most 0.12% of carbon, at most 1% of manganese, at most 1% of silicon, at most 0.040% of phosphorus, at most 0.030% of sulfur and between 16 and 18% of chromium, wherein it is capable of being obtained by the above process.

As will have been understood, the invention consists, starting from a twin-roll cast strip of ferritic stainless steel of standard composition, in cooling and coiling the said strip under special conditions, before subjecting it to box annealing. The purpose of this treatment is essentially to limit as far as possible the formation of coarse embrittling carbides. To do this, it is necessary to limit the precipitation of carbides and to encourage the transformation of austenite into martensite at the as-cast stage while preventing, however, this martensite transformation from occurring until the strip has been coiled.

BRIEF DESCRIPTION OF THE DRAWINGS

The invention will be more clearly understood on reading the description which follows, with reference to the following appended figures.

DESCRIPTION OF THE PREFERRED EMBODIMENTS

Figure 1:
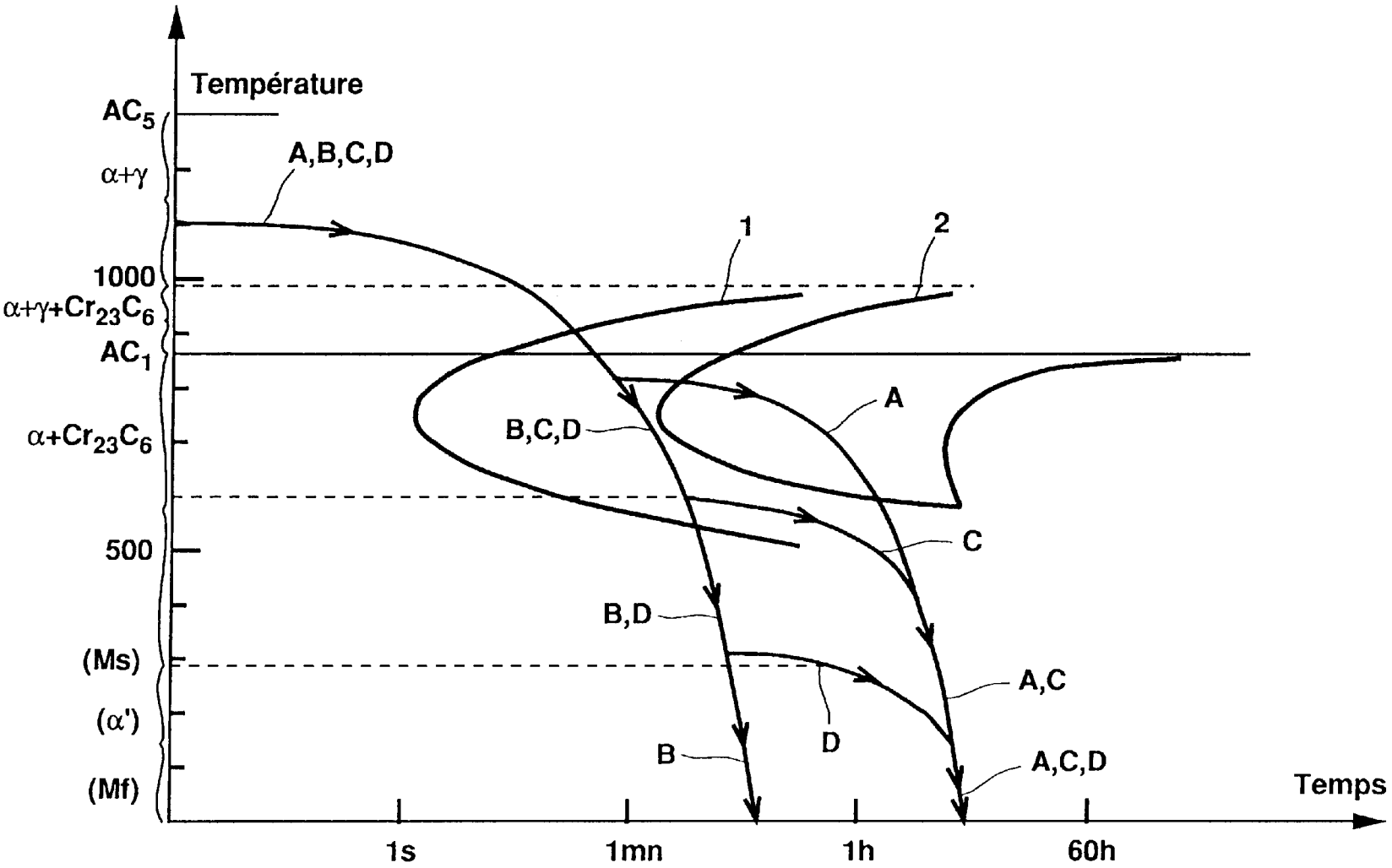
FIG. 1 which plots, on a diagram showing the cooling transformation curves of the AISI 430 grade, four examples A, B, C, D of thermal paths followed by the strip after it leaves the casting rolls, including two examples, C and D, in which it undergoes a treatment according to the invention.

In the rest of this description, steels will be considered whose composition satisfies the usual criteria of the AISI430 grade with regard to standard ferritic stainless steels, therefore those containing at most 0.12% of carbon, at most 1% of manganese, at most 1% of silicon, at most 0.040% of phosphorus, at most 0.030% of sulfur and between 16 and 18% of chromium. However, it goes without saying that the field of application of the invention may be extended to steels containing, in addition, alloying elements not necessarily required by the usual standards (for example, stabilizers such as titanium, niobium, vanadium, aluminum, molybdenum), insofar as their contents would not be high to the point of counteracting the metallurgical processes which will be described and upon which the invention is based. In particular, the presence of these alloying elements should not alter the appearance of the transformation curves of the example in FIG. 1 to the point that the thermal paths that the strip must follow, according to the invention, would be no longer accessible on a twin-roll casting plant.

The steels which form the subject of the trials, the results of which will be described and commented upon in connection with FIGS. 1 to 3, had the following composition, expressed in percentages by weight;

carbon: 0.043%;
silicon: 0.24%;
sulfur: 0.001%;
phosphorus: 0.023%;
manganese: 0.41%;
chromium: 16.36%;
nickel: 0.22%;
molybdenum: 0.043%;
titanium: 0.002%;
niobium: 0.004%;
copper: 0.042%;
aluminum: 0.002%;
vanadium: 0.064%;
nitrogen: 0.033%;
oxygen: 0.0057%;
boron: less than 0.001%;

i.e. a carbon+nitrogen total of 0.076% (this being normal with such grades), a $\gamma p$ criterion, calculated from the usual formula, mentioned above, equal to 37.6% (which is not particularly low, especially because of the relatively low vanadium, molybdenum, titanium and niobium contents, and an Ac1 temperature for transformation of ferrite to austenite during the 851° C. reheat. The latter temperature is calculated by means of the conventional formula;

$$Ac1=35\times\%Cr+60\times\%Mo+73\times\%Si+170\times\%Nb+290\times\%v+620\times\%Ti+750\times\%Al+1400\times\%B-250\times\%C-280\times\%N-115\times\%Ni-66\times\%Mn\ 18\times\%Cu+310.$$

As explained above, when such an as-cast strip is coiled at around 700–900° C. without having been force-cooled, and then left to cool naturally in the coiled state before undergoing box annealing, the ductility properties of the strip after this annealing are not satisfactory. The reason for this is that the slow cooling in the coil involves the metal passing into the region for precipitation of chromium carbides of the $Cr_{23}C_6$ type from ferrite (which precipitation occurs at the ferrite grain boundaries and at the ferrite/austenite interfaces) and above all into the region for decomposition of austenite into ferrite and chromium carbides of the $Cr_{23}C_6$ type. This mechanism favors the growth of coarse embrittling carbides, and the box annealing which follows accentuates the coalescence of coarse carbides in the form of continuous films. The transformation curves in FIG. 1, valid for the AISI 430 grade in question, illustrate this phenomenon.

Plotted in this FIG. 1 are, in particular, the Ac5 temperature representative of the end of the transformation of α-ferrite to γ-austenite during the reheat, the temperature Ac1 of the start of this same transformation, and the Ms and Mf temperatures of the start and end of the transformation of γ-austenite to α-martensite during cooling. Also plotted are curve 1 which defines the temperature range within which $Cr_{23}C_6$-type chromium carbide precipitation takes place at the ferrite grain boundaries and at the ferrite/austenite interfaces and curve 2 which defines the region of the start of the transformation from austenite to ferrite and chromium carbides. Also plotted are four examples A, B, C, D of heat treatments which the cast strip undergoes after it leaves the rolls, including two (C and D) which are representative of the invention.

Treatment A consists, according to the prior art explained above, in allowing the strip to cool naturally in the open air after it leaves the casting rolls and in coiling it at approximately 800° C., while it is in the region for precipitation of chromium carbides at the ferrite grain boundaries and at the ferrite/austenite interfaces. As mentioned, this coiling considerably slows down the cooling of the strip, which is then obliged to remain for a long time within the region for transformation of austenite into ferrite and chromium carbides, before returning to ambient temperature.

Treatment B consists in leaving the strip to cool naturally in the open air, allowing it to reach ambient temperature without coiling it. The strip does not stay in the region for transformation of austenite to ferrite and chromium carbides, but it does undergo a major martensitic transformation between the Ms and Mf temperatures. It will be apparent why such a treatment cannot be included in the invention.

Treatment C representative of the invention, consists in firstly allowing the strip to cool naturally, before being coiled, so as to prevent it from remaining in the region for transformation of austenite to ferrite and chromium carbides, and in carrying out the coiling operation only at a temperature of approximately 600° C. As the coiled strip cools, the latter ends up more or less rejoining the final thermal path of treatment A.

Treatment D, also representative of the invention, is in terms of its principle identical to treatment C, but the coiling of the strip takes place only at a temperature of approximately 300° C. However, this temperature necessarily remains above Ms (which depends on the chemical composition of the steel) and, while the coil is cooling, the strip is prevented from remaining in the region in which the martensitic transformation would take place to a very great extent. Its final thermal path rejoins those of treatments A and C.

Figure 2:
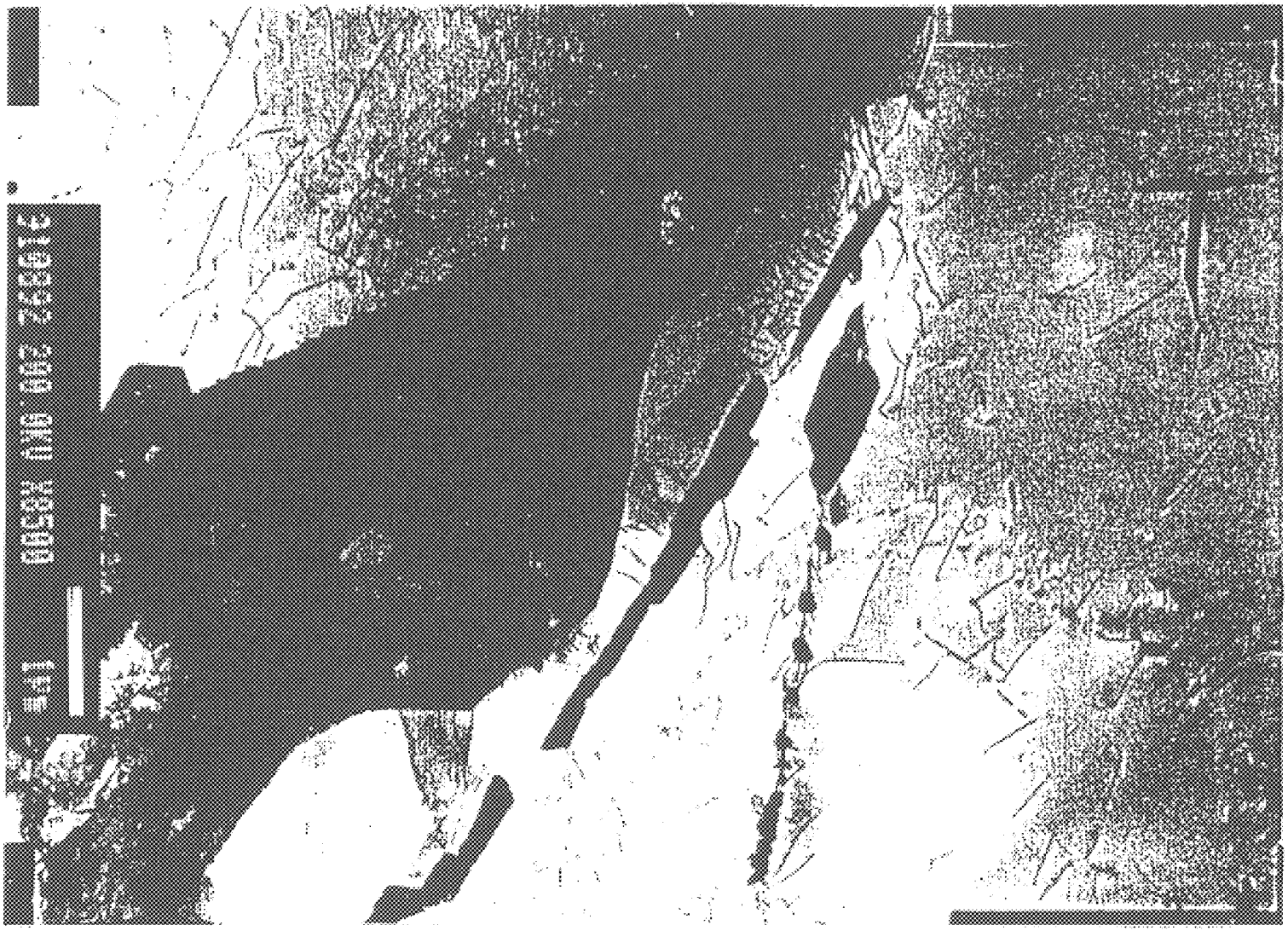
FIG. 2 which shows a transmission electron microscope photograph of a thin foil taken from a strip which has followed the thermal path A in FIG. 1, then box annealing.

The photograph in FIG. 2 shows a portion of a specimen from a reference strip which has followed thermal path A of FIG. 1 (therefore 800° C. coiling) in order to be taken to ambient temperature in coiled form and which was then subjected to box annealing under standard conditions, namely a residence time of 6 hours at approximately 800° C. The strip has the chemical composition mentioned above and a thickness of 3 mm. In the photograph it may be seen that most of the specimen consists of coarse ferritic grains 3. The areas 4 having small ferritic grains arising from the transformation of the α' martensite during the box annealing representing only a small fraction of the specimen. Above all, the presence within the structure of continuous chromium carbide films 5 will be noted. These carbide films result from the fact that, initially, the slow cooling of the coiled strip in the region for transformation of austenite into ferrite and carbides has caused extensive carbide precipitation and that, subsequently, the box annealing has accentuated the coalescence of these carbides. As will be seen, the presence of these continuous carbide films is one cause of the poor ductility of the metal.

Figure 3:
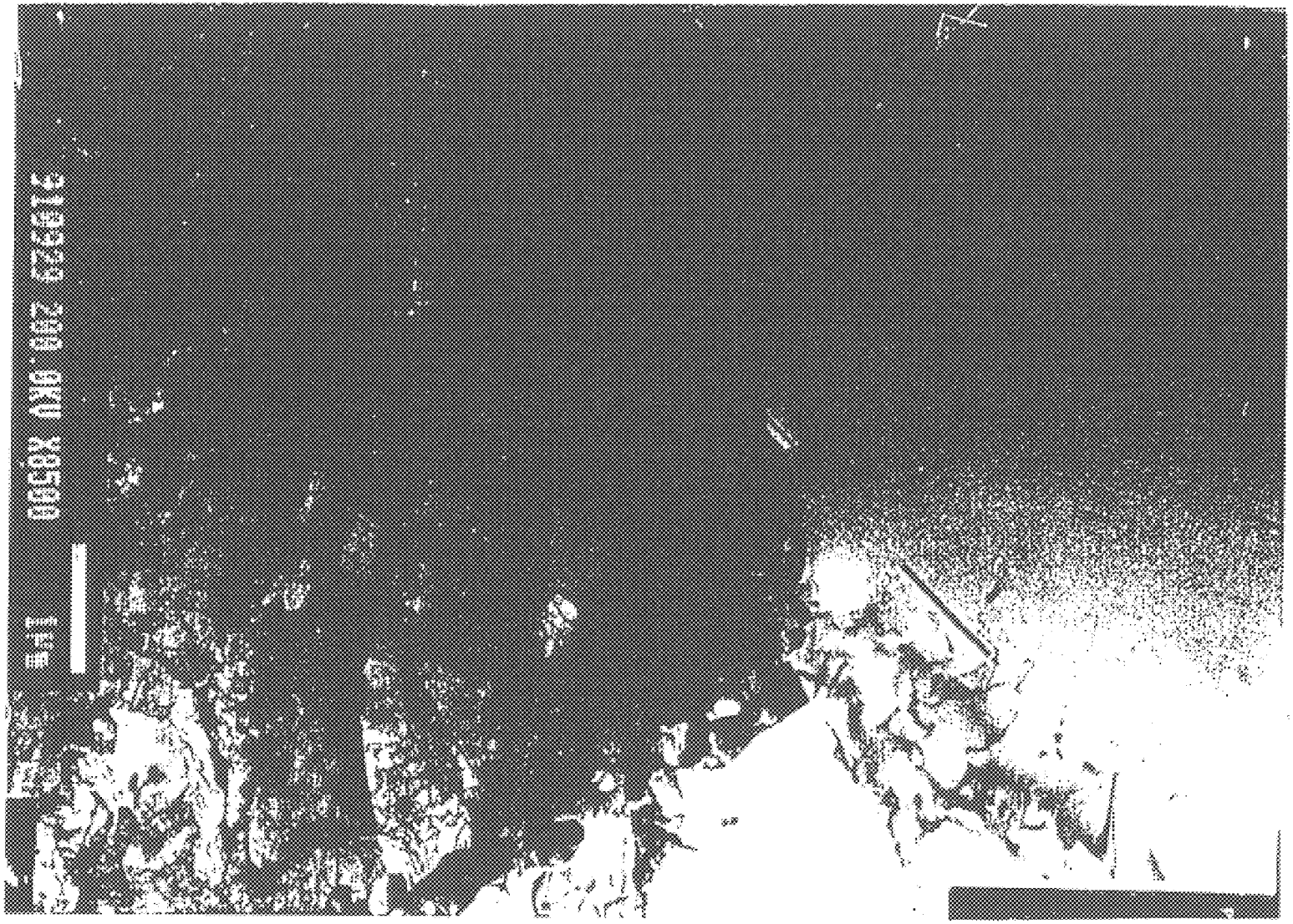
FIG. 3 which shows a transmission electron microscope photograph of a thin foil taken from a strip which has, according to the invention, followed an intermediate thermal path between the paths C and D in FIG. 1, and then box annealing.

The photograph in FIG. 3 shows a portion of a specimen taken from a strip according to the invention (of the same composition and thickness as that in FIG. 2) which has followed an intermediate thermal path between paths C and D in FIG. 1 down to ambient temperature (the strip was coiled at 500° C.) and then underwent box annealing identical to that undergone by the reference specimen of FIG. 2. It will be seen that the coarse ferritic grains 3 are still present but the areas 6 consisting of small ferritic grains arising from the transformation of (α'-martensite are in greater proportion. The fact of making the strip pass rapidly through the carbide and nitride precipitation region and of making it avoid the austenite to ferrite and carbides precipitation region has firstly led to a limited precipitation of fine carbides in the ferrite (this being inevitable, given the rapidity of their precipitation). In addition, large areas of austenite, richer in carbon and nitrogen than the ferrite, have thus remained, these being subsequently transformed into martensite. During the box annealing which followed, fine carbides precipitated within the ferrite and the martensite decomposed into ferrite and fine carbides which are much more homogeneously distributed than in the reference specimen of FIG. 2. Thus, continuous films of coalesced carbides are no longer observed, rather, at the very most, discontinuous strings 7 of small carbides (less than 0.5 μm) at the boundaries between the coarse ferritic grains and the areas consisting of small ferritic grains scattered with carbides. These small carbides are markedly less sensitive to crack initiation than the continuous films of the reference specimen. The noticeable appearance of areas consisting of small ferritic grains during box annealing is due to the relaxation of the stresses stored during martensite formation, giving rise to a regeneration phenomenon. These areas of small ferritic grains are much ductile than the matrix consisting of coarse ferritic grains, and make it possible to limit the brittleness of the metal, especially by slowing down the propagation of cracks by cleavage.

The ductility of the strip obtained by the reference process and that gained by the process according to the invention were evaluated by impact bending tests on "V"-notched Charpy test pieces, during which their toughness was evaluated by measuring the energy absorbed by the specimens at 20° C. The tests were carried out on strip specimens removed before and after box annealing. Their results are given in Table 1 below:

TABLE 1

Toughness of the strip specimens as a function of the coiling temperature

| | Energy absorbed at 20° C. before box annealing | Energy absorbed at 20° C. after box annealing |
|---|---|---|
| Strip coiled at 800° C. (reference) | ≈5 J/cm$^2$ | ≈5 J/cm$^2$ |
| Strip coiled at 500° C. (invention) | ≈5 J/cm$^2$ | ≈60 J/cm$^2$ |

It may be seen that the coiling temperature has no effect on the 20° C. ductility of the as-cast strip which has not yet undergone box annealing. This ductility is very poor and it is not improved by the box annealing in the case of the hot-coiled reference strip. As was seen in the photograph in FIG. 2, the box annealing was, in this reference case, incapable of promoting a metal-matrix structure and a carbide distribution which are favorable to good ductility. On the other hand, the ductility of the strip coiled under the conditions recommended by the invention was able to be considerably improved by the box annealing and raised it to a very satisfactory level. This is because experience shows that a toughness of the order of 30 to 40 J/cm$^2$ is sufficient for cold treatments (uncoiling and edge cropping, in particular) to be able to be carried out without damaging the strip.

The fact of a coiled strip having avoided passing through the austenite to ferrite and carbides transformation region resulted, during cooling of the strip, in the formation of fine carbides in the ferrite, the morphology and distribution of which are substantially more favorable to the formation, after the box annealing, of fine and uniformly distributed carbides. These are therefore much less prejudicial to the ductility of the strip that the continuous carbide films observed in the reference specimen. The metal matrix obtained after cooling the strip coiled at low temperature, which is richer in martensite, is also more favorable to good ductility of the final strip since the box annealing acts effectively on the martensite in order to decompose it essentially into small-grained ferrite.

Another test representative of the ductility of these same strips after the box annealing was carried out. It consists in subjecting a test piece, the edges of which are as-cropped or have been machined, to 90° reverse bending. One bending cycle corresponds to an operation consisting in bending the specimen through 90° and then bending it back to its initial straight configuration. The number of bending cycles that it is possible to perform before the specimen breaks or shows cracks in the bend region is determined. Table 2 below gives the average of the results of these experiments.

TABLE 2

Average number of bending cycles before fracture or appearance of cracks as a function of the coiling temperature.

| | Machined edges | Cropped edges |
|---|---|---|
| Strip coiled at 800° C. (reference) | 2 | 0 |

TABLE 2-continued

Average number of bending cycles before fracture or appearance of cracks as a function of the coiling temperature.

| | Machined edges | Cropped edges |
|---|---|---|
| Strip coiled at 500° C. (invention) | 6 | 4 |

A number of bending cycles equal to 0 means that the strip does not withstand even being bent merely once before the first cracks appear or it purely and simply fractures. Again, it is striking that the strip which was produced in accordance with the invention behaved much better than the reference strip, for the reasons which were given previously.

In summary, the first basic idea of the invention is to impose on the strip leaving the rolls a cooling path which makes it possible to limit the precipitation of carbides, above all avoiding those which might stem from the decomposition of austenite and which would be likely to coalesce into continuous coarse films during box annealing. The second idea is to promote, at the same production stage, the transformation of austenite into martensite so as to obtain as far as possible fine-grained ferrite during box annealing. These conditions are achieved if the time spent by the cast strip in the region for precipitation of carbides and nitrides from ferrite is limited, and above all if the strip is prevented from remaining in the austenite to ferrite and carbides transformation region. In practice, the achievement of these conditions on AISI 430 grades and those which are similar requires the strip to be coiled at 600° or below in order to avoid the strip remaining in the region for transformation of austenite into ferrite and carbides while it is being coiled. Depending on the particular casting conditions, such as the thickness of the strip, the casting rate and the distance separating the rolls from the coiler, these conditions may be fulfilled simply by cooling the strip naturally in air or may require the use of a plant in which the strip is force-cooled, for example by means of spraying a coolant such as water or a water/air mixture. It is considered that the desired results are generally achieved by imposing on the strip a cooling rate greater than or equal to 10° C./s between the time when it leaves the rolls and the time when it reaches a temperature of 600° C. at or below which the coiling can take place.

However, the formation of martensite while the strip is cooling must be controlled so that it does not itself become problematic. In the first place, it is imperative to prevent martensite from forming before coiling, as it would lead to a high risk of the strip breaking during coiling. To do this, it is necessary for the coiling to be carried out at a temperature above the austenite to martensite transformation temperature Ms, i.e. approximately 300° C. Moreover, if the coil is cooled too rapidly (greater than 300° C./h), this would lead to an excessive formation of very hard martensite. The latter would make the strip too brittle to readily withstand the manipulations of the coil prior to annealing. The example of treatment B in FIG. 1 is representative of the defects which might result from cooling the strip too rapidly; the absence of coiling resulted in an average cooling rate of approximately 1000° C./h. After this cooling, the strip had a hardness of 192 Hv, which is too high, while the reference strip which had followed path A had a hardness of 155 Hv. The strips according to the invention, which underwent an intermediate treatment between paths C and D have hardnesses of about 180 Hv. It should be considered that the coiled strip must not be cooled at a rate greater than 300°

C./h. In practice, this condition is generally satisfied on industrial-format plants when no special measures are taken to increase the rate of cooling of the coils (a natural cooling rate in air of about 100° C./h is usually observed).

Moreover, in order to obtain good results, it is necessary to wait, before carrying out the box annealing, until the coiled strip has cooled sufficiently for there to have been time for the desired transformations to occur, in particular the austenite to martensite transformation. In practice, the box annealing must be carried out on a coil whose initial temperature is between ambient and 200° C. Typically, it is carried out at a temperature of 800–850° C. for at least 4 hours.

Compared with the other existing processes aimed at improving the ductility of ferritic stainless steel strip containing approximately 17% of chromium, the process according to the invention has the advantage of not requiring special and expensive modifications of the grade, such as incorporating stabilizers and/or reducing the carbon and nitrogen contents down to unusually low levels. It may be carried out on a twin-roll continuous caster which does not need to be equipped with a plant for hot-rolling the strip leaving the rolls. Nor does it require special adaptations of the post-casting steps in the manufacturing cycle (box annealing, edge cropping, pickling, etc.). The only modification to a standard twin-roll casting plant that its installation is likely to require is possible addition of a device for cooling the strip beneath the rolls. Such a device, which could be of a very simple design, would make it possible to ensure that the strip never remains within the austenite to ferrite and carbides transformation region and that the coiling always takes place at 600° C. or below, whatever the casting rate and the thickness of the strip, and even if the coiler is located quite close to the rolls (which may, on the contrary, be desirable for casting other types of steel).

It remains within the spirit of the invention to apply the process described above to twin-roll cast strip which is hot rolled below the casting rolls when, moreover, the required strip-cooling and strip-coiling conditions are fulfilled. It may be desirable to carry out such hot rolling in order to improve the internal soundness of the strip, by closing up any porosity therein, and to improve its surface quality. In addition, hot rolling, carried out at temperatures from 900 to 1150° C. with a reduction ratio of at least 5%, has a beneficial effect on the ductility of the strip, experience showing that the ductility increases with the effect of the process according to the invention, without it being necessary to fulfill the very strict analytical conditions indicated in the document EP-A-0,638,653 already mentioned. It is thus possible for the strip to have greater ductility than that which the sole application of hot rolling or the sole application of the basic version of the process according to the invention would allow to be achieved.

By way of example, tests were carried out on a twin-roll cast steel strip having a thickness of 2.7 mm and a composition (expressed in percentages by weight) of:

carbon: 0.040%;
silicon: 0.23%;
sulfur: 0.001%;
phosphorus: 0.024%;
manganese: 0.40%;
chromium: 16.50%;
nickel: 0.57%;
molybdenum: 0.030%;
titanium: 0.002%;
niobium: 0.001%;
copper: 0.060%;
aluminum: 0.003%;
vanadium: 0.060%;
nitrogen: 0.042%;
oxygen: 0.0090%;
boron: less than 0.001%.

This composition corresponds to a γp criterion of 46.5% and to an Ac1 temperature of 826° C.

In the absence of hot rolling, when the coiling of strip is carried out at 800° C. (in accordance with treatment A in FIG. 1) before box annealing, the strip does not withstand a single bending cycle on its cropped edges, fracture occurring immediately. In the case of coiling at 670° C., the strip withstands only a single bending cycle on its cropped edges. However, if the coiling is carried out at 500° C. according to the process of the invention, the strip can withstand 4 bending cycles on its cropped edges. These tests therefore confirm those of the example illustrated in FIGS. 1 to 3.

In addition, when said strip undergoes hot rolling at a temperature of 1000° C. with a thickness-reduction ratio equal to 30%, coiling carried out at 500° C. according to the invention gives the strip an energy absorbed at 20° C. (after box annealing) of 160 J/cm$^2$, under test conditions which are similar to those of the tests in Table 1 above. By comparison, if the coiling is carried out at 800° C., the energy absorbed at 20° C. is only 100 J/cm$^2$.

Strip capable of being produced by the process according to the invention is distinguished from strip from the prior art essentially in that it combines:

- a columnar structure consisting of coarse ferritic grains coexisting with many areas consisting of small ferritic grains scattered with carbides;
- the absence of continuous films of coarse carbides, these being replaced by strings of small discontinuous carbides at the boundaries between the coarse ferritic grains and the areas consisting of small ferritic grains;
- if, according to the basic version of the invention, the strip is not hot rolled before it is coiled, the absence of structures which conventionally indicate that the strip was hot rolled;
- and, generally, the absence of significant amounts of stabilizing elements, such as niobium, vanadium, titanium, aluminum and molybdenum; as mentioned, such elements may possibly be present for various reasons, but they have no appreciable influence on the ductility of the strip.

Its good ductility makes this strip capable of subsequently undergoing, without any damage, the usual metallurgical operations which will convert it into end-products usable by a customer, in particular cold rolling.

What is claimed is:

1. A process for manufacturing thin strip ferritic stainless steel, comprising the steps of solidifying, directly from a molten state, a strip of ferritic stainless steel including at most 0.12% of carbon, at most 1% of manganese, at most 1% of silicon, at most 0.040% of phosphorus, at most 0.030% of sulfur and between 16 and 18% of chromium, said strip being solidified between two close-together, internally-cooled, counterrotating rolls with horizonal axes; cooling said strip or leaving said strip to cool to prevent said strip from remaining within an austenite to ferrite and carbides transformation range, coiling said strip at a temperature of between 600° C. and a martensitic transformation temperature; cooling the coiled strip at a maximum rate of 300° C./h down to a temperature of between 200° C. and ambient temperature, and then box annealing said strip.

2. The process as claimed in claim 1, wherein said box annealing step is carried out at a temperature of 800 to 850° C. for at least 4 hours.

3. The process as claimed in claim 1 wherein the strip is prevented from remaining within the austenite to ferrite and carbides transformation region by giving it a cooling rate greater than or equal to 10° C./s, at least between the time when the solidified strip leaves the rolls and the time when it reaches a temperature of 600° C.

4. The process as claimed in claim 3, wherein said cooling rate is achieved by spraying a coolant onto the surface of the strip.

5. The process as claimed in claim 1, further comprising the step of hot rolling said strip at a temperature of between 900 and 1150° C. with a strip-thickness reduction ratio of at least 5% prior to coiling the strip.

6. A strip of ferritic stainless steel containing at most 0.12% of carbon, at most 1% of manganese, at most 1% of silicon, at most 0.040% of phosphorus, at most 0.030% of sulfur and between 16 and 18% of chromium, which is obtained by the process of claim 1, and which has a columnar structure including coarse ferritic grains coexisting with areas of smaller ferritic grains scattered with carbides, and strings of small discontinuous carbides at boundaries between the coarse ferritic grains and the areas of small ferritic grains.

7. The process as claimed in claim 1, wherein said strip has a thickness of less than 10 mm.

* * * * *